United States Patent [19]

Carlson

[11] 4,333,603

[45] Jun. 8, 1982

[54] MAILBOX WITH LOCKABLE LETTER MAIL COMPARTMENT FOR USE IN MOTORIZED DELIVERY ROUTES

[76] Inventor: Raymond A. Carlson, 4147 E. Whittier, Tucson, Ariz. 85711

[21] Appl. No.: 112,296

[22] Filed: Jan. 15, 1980

Related U.S. Application Data

[63] Continuation-in-part of Ser. No. 957,536, Nov. 3, 1978, abandoned.

[51] Int. Cl.[3] ..... A47G 29/12

[52] U.S. Cl. ..... 232/17; 232/24; 232/33

[58] Field of Search ..... 232/17, 24, 33

[56] References Cited

U.S. PATENT DOCUMENTS

| | | | |
|---|---|---|---|
| 379,302 | 3/1888 | Archer | 232/24 |
| 435,306 | 8/1890 | Hill | 232/24 |
| 446,257 | 2/1891 | Lane | 232/33 |
| 755,038 | 3/1904 | Palmer | 232/24 |
| 1,123,650 | 1/1915 | Anderson | 232/33 X |
| 1,397,438 | 11/1921 | Martin | 232/24 |
| 2,945,621 | 7/1960 | Kopprasch et al. | 232/24 |

FOREIGN PATENT DOCUMENTS

| | | | |
|---|---|---|---|
| 652003 | 12/1964 | Belgium | 232/24 |
| 587039 | 2/1975 | Switzerland | 232/24 |
| 570143 | 12/1975 | Switzerland | 232/24 |

*Primary Examiner*—Roy D. Frazier
*Assistant Examiner*—Peter A. Aschenbrenner
*Attorney, Agent, or Firm*—Freilich, Hornbaker, Wasserman, Rosen & Fernandez

[57] ABSTRACT

A mailbox is provided with a lockable letter-mail compartment within in the form of a rectangular box having at least four sides and a hinged door with a key operated mechanism for locking it in the closed position, secured to the floor, side or roof of a mailbox for use in motorized delivery routes, or in the form of a shelf secured between side walls of the mailbox and a hinged door with a lock. The compartment has a slot for receiving letter mail without opening the door of the compartment. The slot is preferably in the locked door of the compartment. The height of the lockable compartment is sufficient to permit mail to be extracted through the hinged door, but of a height significantly less than the height of the mailbox to permit mail other than letters to be placed in the mailbox outside of the compartment.

3 Claims, 8 Drawing Figures

MAILBOX WITH LOCKABLE LETTER MAIL COMPARTMENT FOR USE IN MOTORIZED DELIVERY ROUTES

This invention is a continuation-in-part of application Ser. No. 957,536, filed Nov. 3, 1978, now abandoned.

BACKGROUND OF THE INVENTION

This invention relates to an improvement in mailboxes for use in motorized city delivery routes, and more particularly for providing a lockable letter-mail compartment in mailboxes approved for motorized city delivery routes.

Standard and approved mailboxes made out of galvanized metal are used everywhere for motorized mail delivery, not only in rural areas but also in many urban areas where the postal service will deliver mail only to a box at the curb from a motor vehicle. Section 155.4 of the Domestic Mail Service Manual of the United States Postal Service requires all new housing tracts in the country to have mailboxes accessible from the delivery person's vehicle. Since considerable pedestrian traffic can be expected in such urban (or suburban) areas, the security of letter mail becomes a matter of concern, particularly to the elderly who regularly receive Social Security, retirement or other types of checks on which they depend for meeting monthly living expenses. It is simply too easy for a pedestrian to casually stroll by a mailbox and take letter mail out without being observed, or arousing any suspicion if observed by persons who do not reside at that address.

Standard rural mailboxes approved for motorized delivery service in the city (urban and suburban) have a flat, though often corrugated or ribbed, plate for the floor, a flat plate for the back, a hinged door for the front, and a continuous plate extending up from one side of the floor and over the top to the other side of the floor for either a flat or curved top. With the hinged door pulled open, all classes of mail—first, second, third and fourth—may be placed in the mailbox where it is protected against all types of inclement weather once the hinged door is closed.

A major problem with these rural-type mailboxes is that mail is not protected against theft. It is not feasible to provide locks for these mailboxes because even if the rural mail carrier were to be provided with a master key, time would not permit him to unlock and relock every mailbox. It would be possible to provide a lock for the mailbox to which the mail carrier has no key, and to provide a mail slot into the box that is protected against inclement weather by a hinged flap, but then the mail carrier would not be able to place other mail, such as newspapers, magazines, small parcels and the like, in the mailbox where it would be protected from the weather. An object of this invention is to provide a way for locking letter mail in a rural-type mailbox and still allow for less important mail to be placed unlocked in the mailbox where it will be protected against the weather.

SUMMARY OF THE INVENTION

In accordance with the present invention, a lockable compartment with a letter slot is secured inside a rural-type mailbox. The lockable compartment is preferably as wide as the rural-type mailbox, but significantly less than the height of the rural-type mailbox. The depth of the compartment may be the full length of the rural-type mailbox, less a small dimension to permit the hinged door of the rural-type mailbox to close. In a preferred embodiment, the compartment is made to have four walls forming a rectangular box with a lockable hinged door at one end. The rear of the compartment, i.e., the end opposite the lockable hinged door, may be closed by a plate in the case of a box shorter than the rural-type mailbox, or by the back plate of the rural-type mailbox. Thus, the compartment may be a box closed at the rear end by a plate and closed at the front end by a hinged door that may be locked in the closed position by a key-operated mechanism. The side walls, top and floor of the lockable box may be one continuous sheet formed in the shape required. This lockable box is secured to an interior flat surface of the rural type mailbox which extends the length of the rural-type mailbox, preferably the floor, a side, or both the floor and a side. In an alternative embodiment, the compartment is formed by a plate permanently affixed between side walls of the rural-type mailbox to divide its interior space into two compartments. A hinged door shaped to close one of the two compartments at the front is then provided with a key-operated mechanism to secure the one compartment closed by the lockable hinged door. The rear of the compartment may be closed by a plate in the case of a box shorter than the rural-type mailbox, or by the back plate of the rural-type mailbox.

The novel features of the invention are set forth with particularity in the appended claims. The invention will be best understood from the following description when read in conjunction with the accompanying drawings.

DESCRIPTION OF PREFERRED EMBODIMENTS

Figure 1:
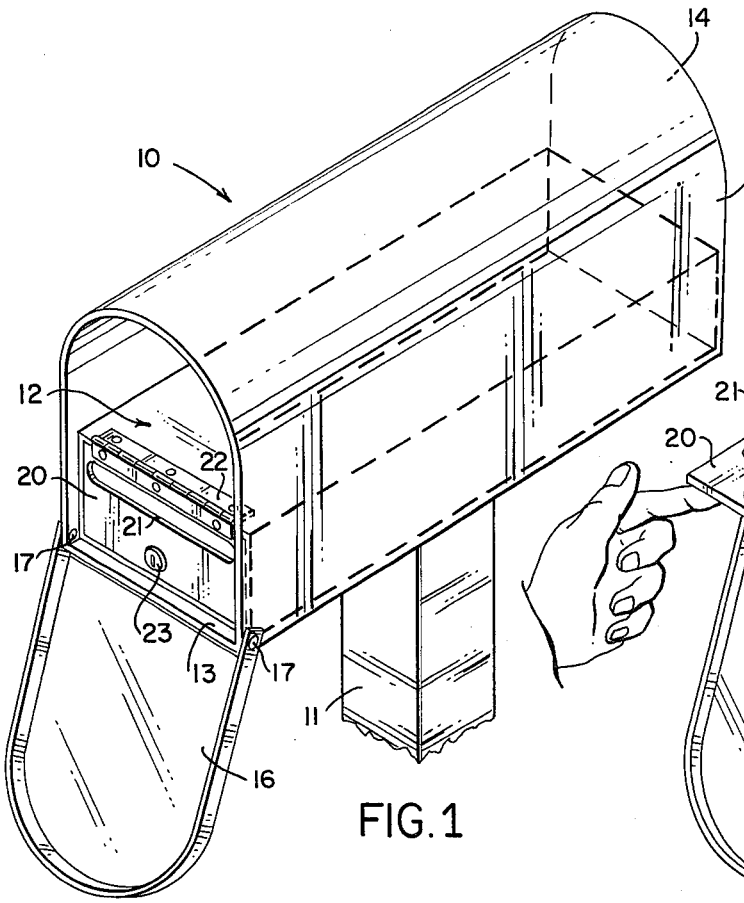
FIG. 1 is an isometric view of a rural type mailbox with a lockable mailbox in accordance with the present invention secured on top of a post.
Figure 2:
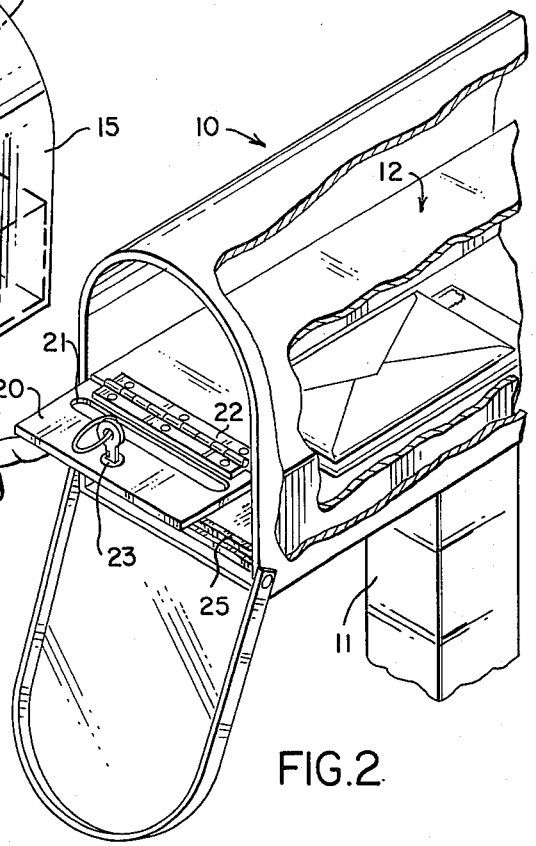
FIG. 2 is a view partially cut away of the rural-type mailbox and the lockable box secured therein, both with their hinged doors open.

Referring now to the drawings, and particularly to FIGS. 1 and 2, there is illustrated a rural-type mailbox 10 on a post 11 with letter-mail compartment comprised of a lockable box 12 secured inside. The rural-type box is comprised of a rigid floor 13, a back wall 14 and a continuous sheet 15 extending up from one side of the floor, over and down to the other side of the floor. The front of the rural-type mailbox is closed by a door 16 hinged on pins. Not shown, but mounted on the left near the front of the rural-type mailbox, is a conventional metal flag painted red in an arrangement that permits the flag to be upright for signalling a mail carrier to stop and pick up outgoing mail.

Figure 3:
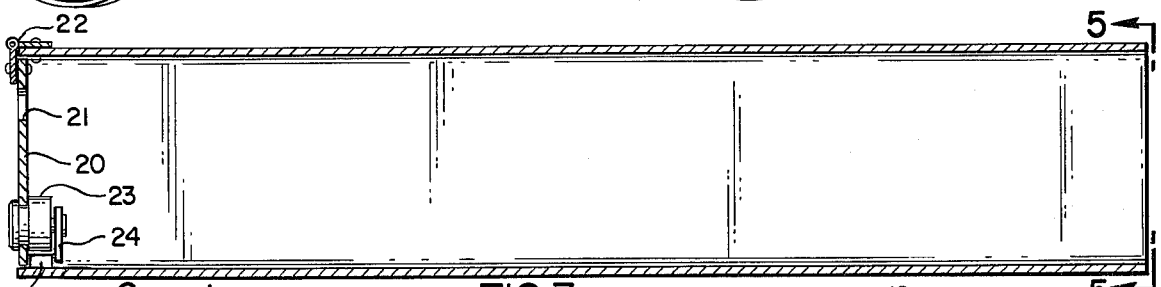
FIG. 3 is a sectional view taken along a line 3—3 in FIG. 5 of the lockable box in FIGS. 1 and 2.
Figure 5:
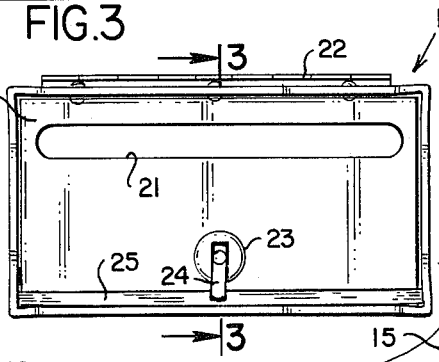
FIG. 5 is an end view taken along a line 5—5 in FIG. 3 of the lockable box.
Figure 6:
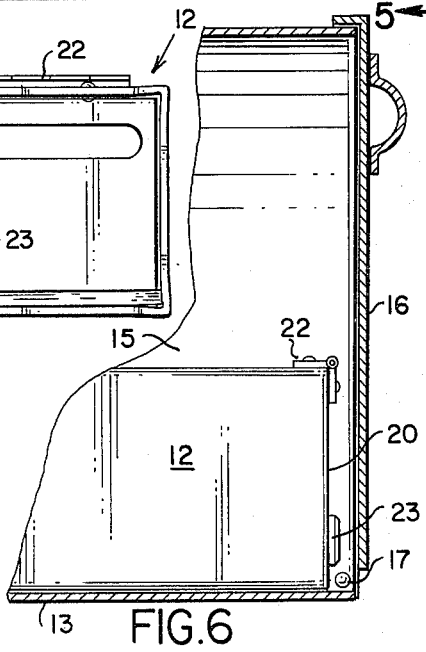
FIG. 6 is a sectional view taken along a line 6—6 in FIG. 4 of the rural-type mailbox.

The lockable box 12 is shown in FIG. 3 in a longitudinal cross section taken along a line 3—3 in the end view of FIG. 5. It is preferably as long as the floor of the mailbox 10 so that when set in the mailbox, its end is against the back plate 14 thereof. In that manner the box 12 may be made without a plate of its own at the rear. As shown, it is also as wide as the floor of the mailbox 10. That is preferred for the smaller (size 1) mailbox that is approximately 6 inches wide. For large (size 1A or size 1) mailboxes, the lockable box may still be only 6 inches wide, since that is adequate for receiving letter mail. In that case the lockable box will not occupy all of the space on the floor of the mailbox, and in some very large mailboxes, a lockable box that is only about 6 inches wide may be turned on its side and secured to a side wall of the mailbox, or to a sidewall and floor of the mailbox.

Figure 4:
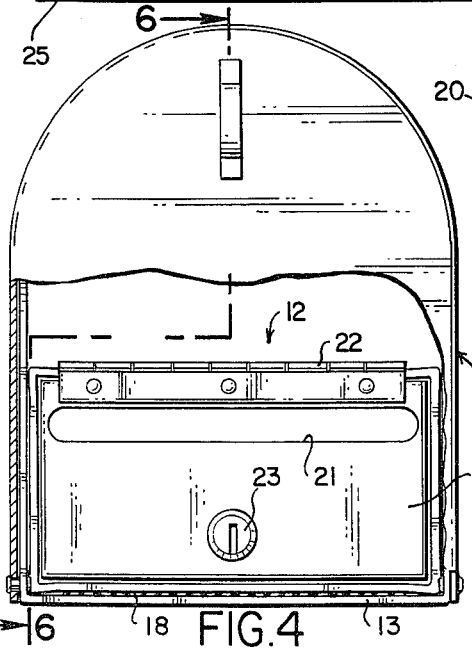
FIG. 4 is a front view of the rural-type mailbox shown in FIG. 1 with the hinged door closed but partially cut away.

In practice, the lockable box may be made of sheet metal, galvanized steel or any other antirust treated metal, aluminum or plastic. If plastic is used, the manufacturing process would be either to extrude a rectangular tube that is then cut to length or cast in parts using heated form dies, and the parts bonded together with epoxy resins or other bonding agents suitable for the plastic material used. If metal is used, the manufacturing process would be to cut, punch or stamp parts from flat stock. The parts are then assembled by using either lock seams, spot welding or rivets. However, if metal is used, a preferred process would be to cut a blank from stock of a dimension equal to the total width of the floor, sides and top of the box. The box is then formed by bending the blank, leaving a seam to be spot welded along the center of the floor. Alternatively, long tubular sections may be formed in the same manner as drain pipes are made for homes. The sections could then be cut to make boxes of desired lengths. In any case, the lockable box is secured to the floor and/or side wall of the rural-type mailbox with an adhesive 18 (FIG. 4) and/or rivets. In the case of a mailbox having a flat top, the lockable box could also be secured to the top and/or side wall.

At the front of the lockable box 12, there is a door 20 with a slot 21. A flange (not shown) may be provided to extend upwardly at about 45° inside the door along the bottom edge of the slot to prevent mail from being withdrawn through the slot once it is inserted. The door is hinged on one side using a riveted piano hinge 22. Secured to the free end of the door is, for example, a key-operated mechanism 23 which may be essentially a conventional cabinet lock affixed to the door in a conventional manner. A locking cam or tab 24 shown in FIGS. 3 and 5 engage a bar 25 securely fastened to the floor of the box, for example by a strong bonding agent or rivets. The bar 25 serves not only as part of the lock mechanism, but also as a stop for the door 20.

FIG. 2 illustrates the lockable box 12 in use. The height of the box (about 3½ inches) is sufficient to permit mail within to be extracted, but significantly less than the height of the rural-type mailbox 10 to permit mail other than letters to be placed over the lockable box inside the rural-type mailbox 10. The height of the lockable box relative to the rural-type mailbox is more clearly shown in FIG. 4.

Figure 7:
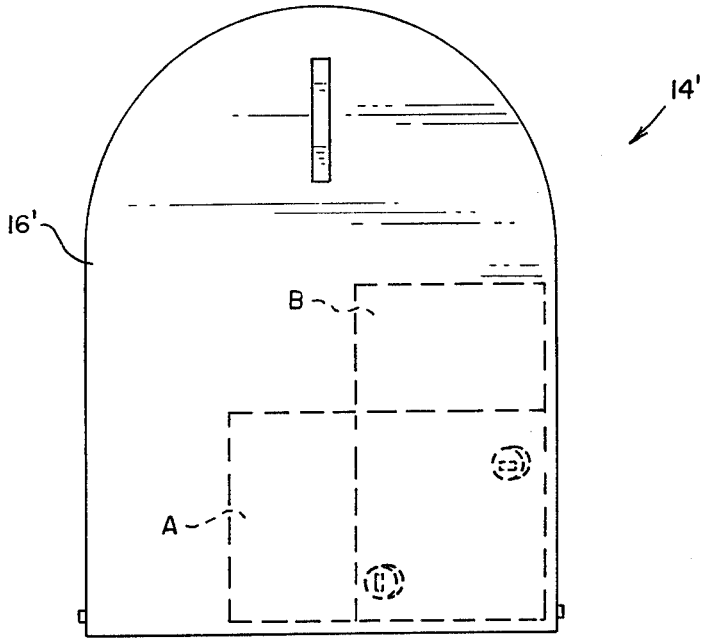
FIG. 7 illustrates two alternative positions of a lockable box of the present invention shown in FIGS. 1 through 6 in a larger rural-type mailbox.

Referring now to FIG. 7, the front of a size 1A rural-type mailbox 14' is shown with its door 16' closed to show in dotted lines two alternative positions for a lockable box described with reference to FIGS. 1 through 6. One position is indicated by dotted line rectangle A, and the other by dotted line rectangle B. In the one position, the lockable box is secured to the floor of the mailbox 14' as in the first embodiment, but the lockable box being of the same size as in the first embodiment will now fill only a part of the floor, leaving room on the side for other mail, such as magazines. In the alternative position, the lockable box is secured to the side of the rural type mailbox. In both positions, an adhesive may be used to secure the lockable box. Note that the adhesive can be applied to floor and sides of the mailbox if desired for greater security.

In a size 2 mailbox, which is even larger than a size 1A mailbox, the lockable box may be positioned in one corner as in the case illustrated for the size 1A, either on the floor or a side wall of the mailbox. In either case, the lockable box should be made of the same length as for the size A mailbox, and not the full length of the size 1A and size 2 boxes, which are longer, because if the lockable box were made longer, the user may not be able to reach all the way to the rear. So with the lockable box shorter than the size 1A or size 2 mailbox, it would be necessary to provide a rear plate for the lockable box, and not rely upon the rear plate of the mailbox to close the lockable box at the rear.

In all of these arrangements for a lockable box, it is preferable to use an adhesive to secure the lockable box to the floor and/or side of the mailbox, particularly where the lockable box is made for installation in a mailbox already in use. A suitable adhesive is commercially available from SEMCO, a division of Products Research & Chemical Corporation, 5454 San Fernando Road, Glendale, Calif. 91203 in kit form as a two-part Model 678 minikit mix for an epoxy.

Figure 8:
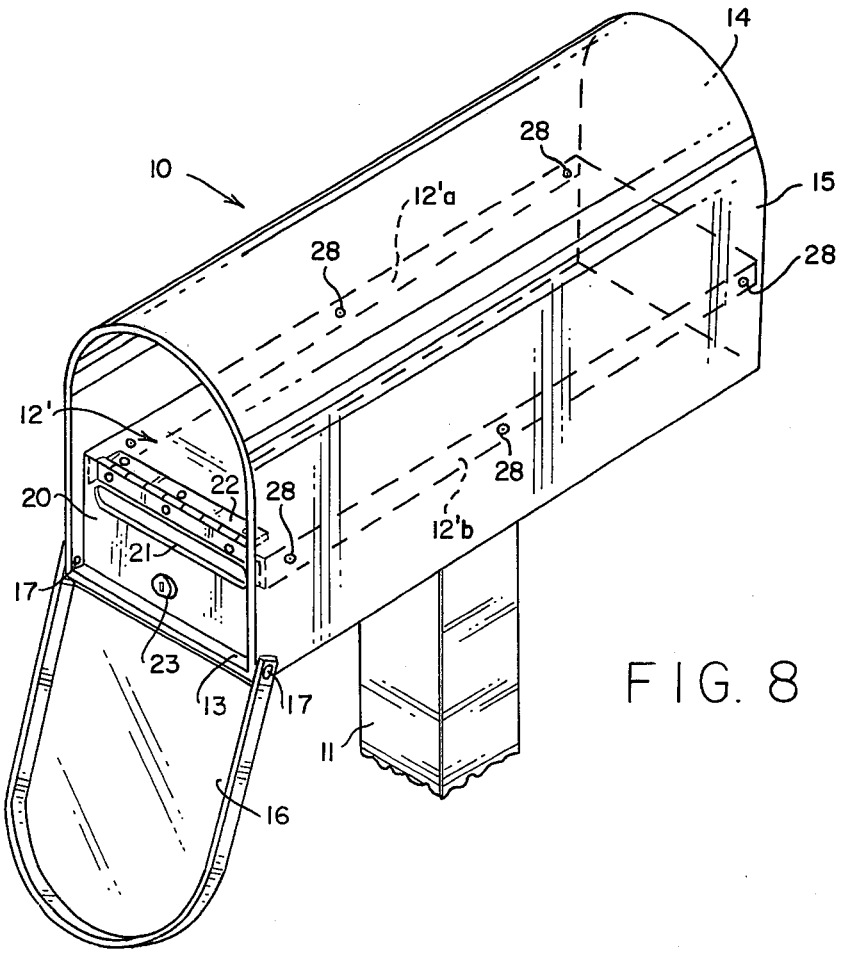
FIG. 8 illustrates an alternative embodiment of the basic invention of providing a separate lockable compartment in a rural-type mailbox.

The second embodiment referred to hereinbefore is illustrated in FIG. 8. It is comprised of a plate 12' that divides the rural-type mailbox into two compartments. The plate 12' is bent on the sides to form two vertical flanges **12'*a* and 12'*b* that are secured to the sides of the mailbox by rivets 28. Either the upper or the lower compartment may be selected to serve as the "lockable box" with the hinged door 20 shaped to fit the opening. The lower compartment is preferred, as shown, because it may then use a rectangular door, but a semicircular door could be readily provided. In the case of a rural-type mailbox having a flat top, the upper compartment could be selected for the "lockable box" with a rectangular door. In any case, the lockable box is thus built into the mailbox using only a plate 12'** to divide it into two compartments.

This second embodiment illustrated in FIG. 8 would likely be used only in the smaller size 1 mailboxes. For larger (size 1A or size 2) mailboxes, the depth of such a compartment may be more than the user can reach. In that case, a baffle (vertical plate) would be provided at the point of maximum depth desired. However, the plate 12' should still extend to the rear wall of the mailbox so as not to leave a space hidden from view into which other mail could fall in the event the lower compartment is chosen as the "lockable box". Although particular embodiments of the invention have been described and illustrated herein, it is recognized that modifications and equivalents may readily occur to those skilled in the art. For example, the slot 21 may be in the top of the lockable box near the front, instead of in the door. Another variant would be to place the slot in a rigid front wall, and relocate the door to the top of the lockable box. The hinge for the door on top could be located from one third to one half the distance back from the front. Also it should be understood that the rural-type mailbox, and other mailboxes which are classified for use on motorized city delivery routes, may be made in configurations other than that illustrated, such as with a square roof. Consequently, it is intended that the claims be interpreted to cover such modifications and equivalents.

What is claimed is:

1. In a rural-type mailbox having a flat rectangular floor, a short back plate, side walls extending no higher than the back plate, and a cover that may be formed by extending the side wall on one side over to the side wall on the other side in a form which conforms to the shape of the back plate, said side walls being flat over at least an initial part extending up from said floor, and a hinged door opposite said back plate, said hinged door conforming to the shape of said back plate to fit the opening between said side walls and between the floor and the cover, the combination of a lockable box inside of said rural-type mailbox for receiving letter mail, said lockable box being comprised of a flat rectangular bottom, flat rectangular sides extending from said bottom to a height less than the height of said back plate of said rural-type mailbox, a top, and a front closure at one end, said lockable box closely fitting inside said rural-type mailbox with the closure thereof placed just behind said hinged door of said rural-type mailbox, a slot in said lockable box through which letter mail may be inserted, said closure comprising a hinged door through which letter mail may be removed from said lockable box, and said hinged door of said lockable box having a key-operated mechanism for locking, and means for securing the bottom of said close fitting lockable box to the floor of said rural-type mailbox with said slot and hinged door of said lockable box accessible through said hinged door of said rural-type mailbox for insertion and removal of letter mail.

2. The combination of claim 1 wherein the bottom, side walls and top of said lockable box extend very nearly to the back plate of said rural-type mailbox, whereby said back plate of said rural-type mailbox may serve as a rear closure for said lockable box.

3. The combination of claim 1 or 2 wherein said slot is in said hinged door of said lockable box.

* * * * *